US006155413A

United States Patent [19]

Bilanchone

[11] Patent Number: 6,155,413

[45] Date of Patent: Dec. 5, 2000

[54] CARPET REFURBISHING KIT

[76] Inventor: Todd C. Bilanchone, 434 SW. 64th Ave., Miami, Fla. 33144

[21] Appl. No.: 09/290,435

[22] Filed: Apr. 13, 1999

[51] Int. Cl.[7] ..... B65D 69/00

[52] U.S. Cl. ..... 206/229; 206/575

[58] Field of Search ..... 206/229, 457, 206/575; 401/129, 270, 277

[56] References Cited

U.S. PATENT DOCUMENTS

| | | | |
|---|---|---|---|
| 737,471 | 8/1903 | Platner . | |
| 1,497,229 | 6/1924 | Reeff . | |
| 2,963,728 | 12/1960 | Michaely . | |
| 3,964,860 | 6/1976 | Leifeld . | |
| 3,993,190 | 11/1976 | Schmidgall | 206/229 |
| 4,218,900 | 8/1980 | Caplan et al. . | |
| 4,424,918 | 1/1984 | Stull . | |
| 4,578,836 | 4/1986 | Otting et al. . | |
| 4,846,201 | 7/1989 | Fuchs et al. . | |
| 5,117,657 | 6/1992 | Tissari . | |
| 5,180,063 | 1/1993 | Sakno | 206/229 |
| 5,402,657 | 4/1995 | Henry, Jr. . | |
| 5,457,845 | 10/1995 | Higgins et al. . | |
| 5,547,303 | 8/1996 | Pyrozyk | 401/270 |
| 5,641,233 | 6/1997 | Wilson | 401/277 |
| 5,669,530 | 9/1997 | Cichon et al. . | |
| 5,743,407 | 4/1998 | Williams | 206/575 |

*Primary Examiner*—David T. Fidei
*Attorney, Agent, or Firm*—Kenneth L Tolar

[57] ABSTRACT

A carpet refurbishing kit includes a liquid dispensing bottle having a rotatable cleaning brush at its lower end and an adjustable spray assembly at its upper end. When rotated in a first direction, the cleaning brush actuates a dispensing nozzle allowing liquid from the container to be delivered therethrough. The spray assembly at the upper end may be adjusted to deliver liquid having a desired spray pattern. The bottle is prepackaged within a container having a plurality of varying configured perforated panels that may be removed to form a template for assisting a user in applying liquid from the bottle to a predetermined area of the carpet.

15 Claims, 2 Drawing Sheets

CARPET REFURBISHING KIT

BACKGROUND OF THE INVENTION

The present invention relates to a carpet refurbishing kit including a bottle for mixing and dispensing carpet dyes or cleaners having an adjustable spray assembly at one end and a cleaning brush with a dispensing nozzle at the other to assist a user in refurbishing carpet.

DESCRIPTION OF THE PRIOR ART

Maintaining household carpet in good condition has long been a problem. Certain stains are often difficult to remove with ordinary cleaners and wet sponges or rags. Furthermore, carpet dye must be periodically re-applied so that the carpet retains its original color. The present invention satisfies the above described problem by providing a uniquely configured dye and cleaner applicator kit including a dispensing bottle having a cleaning brush at one end and a variable delivery spray head at the other end. The kit also includes a plurality of varying colored dyes allowing a user to produce a dye to match most any color carpet. Furthermore, the container is prepackaged in a container having a plurality of variably shaped perforated panels which may be removed allowing the container to be used as a template for applying the dyes.

Various carpet refurbishing devices exist in the prior art. For example, U.S. Pat. No. 5,457,845 issued to Higgins et al discloses an apparatus to refurbish carpet tiles by conveying the carpet with a high pressure liquid dispensing device.

U.S. Pat. No. 5,402,657 issued to Henry, Jr. discloses a device for removing stains from fabric including a piston/nozzle assembly that is lowered to contact the non-stained side of the fabric. Multiple nozzles force cleaning solution through the stained fabric at a high pressure.

U.S. Pat. No. 5,117,657 issued to Tissari discloses a machine for washing carpets having a frame, a plurality of elongated rolls located in the frame for transporting the carpet through the machine and a distributing unit movable along the length of the rolls for spraying cleaning solution on the carpet.

U.S. Pat. No. 4,578,836 issued to Otting et al discloses a method of dying carpet by applying a heated base color and thereafter applying other color dyes.

U.S. Pat. No. 4,218,900 issued to Caplan et al discloses a carpet cleaning and dyeing apparatus including an elongated tubular hose attachable to a vacuum hose.

U.S. Pat. No. 3,964,860 issued to Leifeld discloses a method for dyeing carpets and the like in which a dye film of a width equal to that of the carpet is formed and then interrupted in a varying manner thereby randomly dyeing portions of the carpet.

Although various carpet cleaning devices exist in the prior art, none relate to a uniquely configured applicator for dispensing a carpet cleaner or dye according to the present invention.

SUMMARY OF THE INVENTION

The present invention relates to a carpet refurbishing kit including a hollow dispensing bottle having a lower end and a substantially conical upper end. A carpet cleaning brush is rotatably mounted to the lower end of the bottle which, when rotated, operates a dispensing nozzle. The upper end of the bottle includes a spray head assembly. The bottle is prepackaged in a container having a plurality of variably shaped perforated panels thereon which may be removed allowing the container to be used as a template. The kit also includes a plurality of variably colored dyes which may be used separately or mixed in various proportions to form a dye having a color corresponding to the carpet to which it will be applied. It is therefore an object of the present invention to provide a carpet refurbishing kit that is easy to use and inexpensive to manufacture.

It is another object of the present invention to provide a carpet refurbishing kit having a pair of uniquely designed liquid dispensing nozzles.

It is yet another object of the present invention to provide a carpet refurbishing kit that is prepackaged in a container which may also be used as an applicator template. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
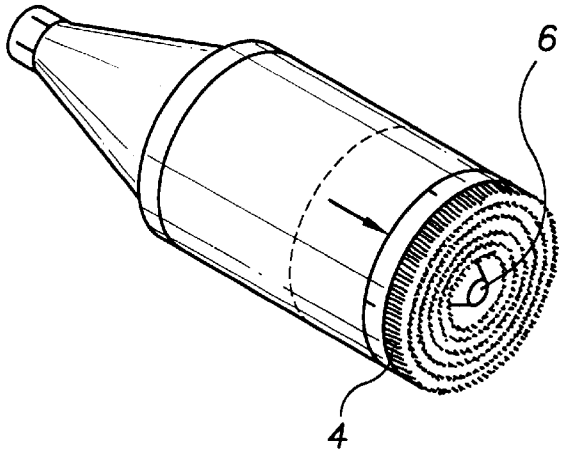
FIG. 1 is a perspective view of the bottle.
Figure 2:
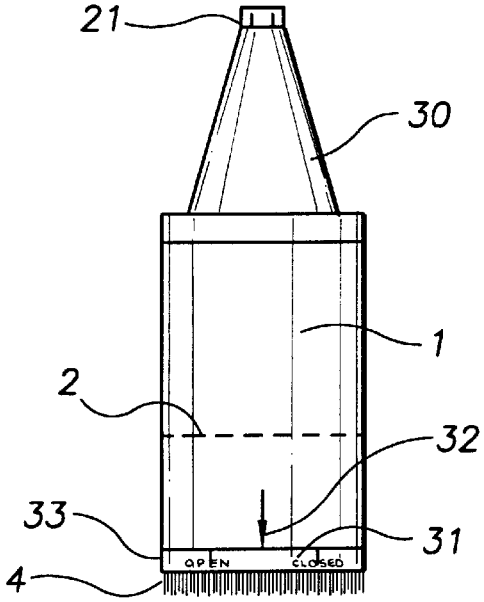
FIG. 2 is a side view of the bottle.

Referring now to FIGS. 1 through 6, the present invention relates a carpet refurbishing kit comprising a hollow, substantially cylindrical dispensing bottle 1 having a lower end 33 and a substantially conical upper end 30. Preferably, the bottle is manufactured with a semitransparent or translucent material allowing a user to determine the amount of liquid therein. The bottle is also preferably somewhat flexible so that the bottle may be squeezed to dispense fluid therefrom. On the exterior surface of the bottle is one or more graduated markings 2 allowing the user to accurately mix cleaning chemicals or dye therein.

Rotatably mounted to the lower end of the bottle is a substantially circular carpet cleaning brush 4. When rotated in either direction, the cleaning brush either opens or closes a dispensing nozzle 6 allowing carpet dye, carpet cleaner or a similar liquid to be delivered through the brush. The brush preferably includes indicia 31 thereon that, when aligned with an arrow 32, indicates whether said dispensing nozzle is opened or closed.

Figure 5:
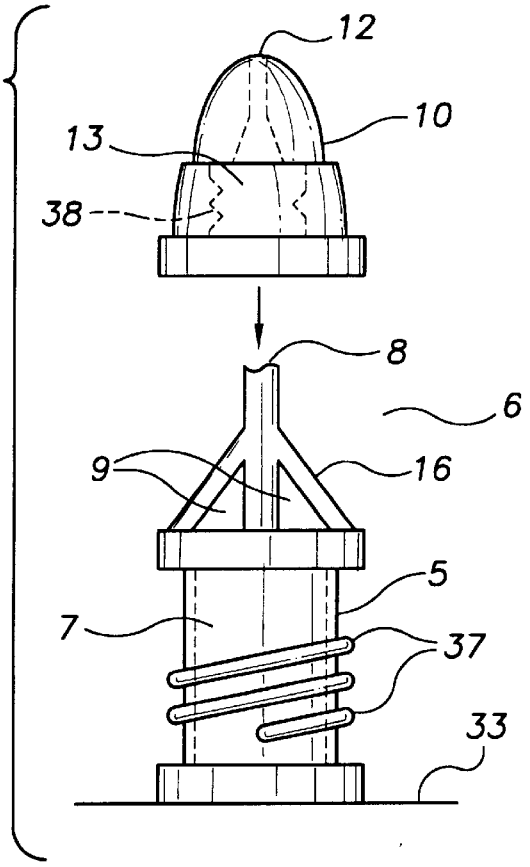
FIG. 5 is a detailed view of the dispensing nozzle.

Referring now to FIG. 5, the dispensing nozzle 6 includes a male member 5 fixedly mounted to the lower end of the bottle having a hollow chamber 7 in fluid communication with the bottle interior. The male member includes external threads 37 and also includes a substantially conical dispensing tip 16 with a plurality of apertures 9 thereon through which liquid from the hollow chamber is dispensed. Extending upwardly from the dispensing tip 16 is a tubular sealing member 8.

Attached to the brush is a female nozzle member 10 having an internally threaded portion 38 which matably engages the male threads on the male member. The female nozzle member includes a dispensing cavity 13 configured similarly to the dispensing tip on the male member. Liquid within the cavity exits the female nozzle member via an outlet port 12. When the brush 4 is rotated in a first direction, the distal end of the sealing member 8 and the cavity outlet port are separated allowing fluid to flow from the male nozzle member outlet apertures to the female member cavity and eventually to the outlet. When the brush member is rotated in a second direction, the sealing member seats tightly within the female member outlet port and the apertures on the male member are sealed by the barrier that defines the cavity preventing liquid from exiting the nozzle assembly.

Figure 6:
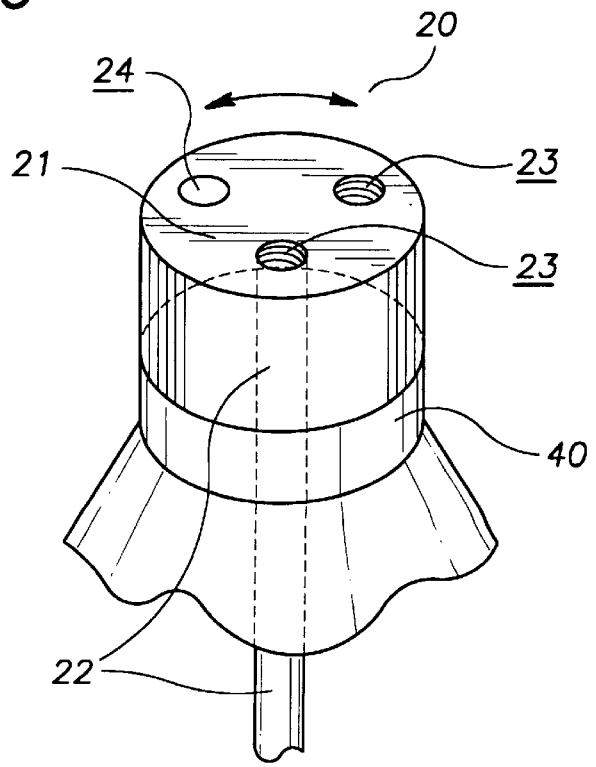
FIG. 6 is a detailed view of the spray assembly.

Referring now to FIG. 6, the upper conical end of the bottle includes a spray assembly 20 for dispensing liquid in a desired spray pattern. The upper end of the bottle includes a neck portion 40 with a cap member 21 rotatably mounted thereon. Fixedly mounted within the neck portion is a dispensing tube 22 that extends to the lower end of the bottle. The top surface of the cap includes a plurality of distribution orifices 23 each designed to form a different spray pattern when liquid is delivered therethrough. The cap also includes a closed portion 24 for preventing liquid from exiting the tube.

To deliver liquid with a desired spray pattern, the cap is rotated until the appropriate orifice registers with the upper end of the tube. The bottle is then inverted and squeezed to dispense the liquid therethrough.

Figure 3:
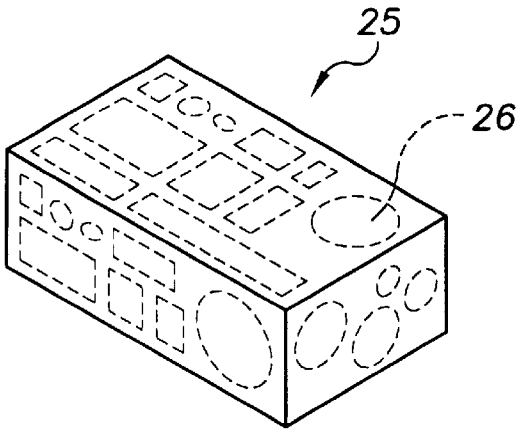
FIG. 3 is a perspective view of the container within which the dispensing bottle is packaged.
Figure 4:
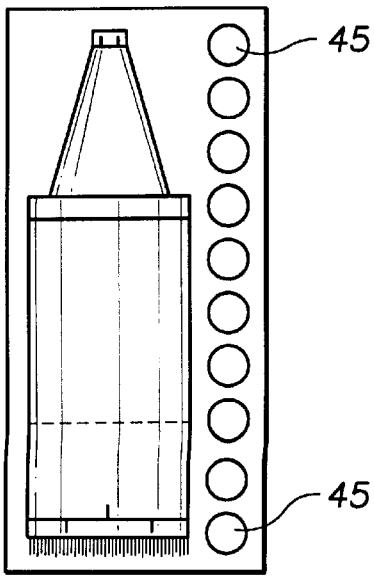
FIG. 4 is a cross-sectional view of the kit according to the present invention including the container and the various dyes.

Referring now to FIGS. 3 and 4, the bottle is preferably packaged in a container 25 or similar enclosure having a plurality of perforated removable portions 26 thereon, each perforated portion having a varying shape or size. A select perforated portion may be removed allowing the container to be used as a template for assisting a user in applying carpet dye or cleaner to a limited area. The kit also includes a plurality of various colored dyes 45 along with instructions on mixing the dyes to form a desired color.

The above described device is not to be limited to the exact details described above. For example, any number of spray orifices may be used. The various components may be constructed with plastic. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A carpet refurbishing kit comprising:

a substantially hollow bottle having an interior liquid retaining chamber, a lower end and an upper end;

a male nozzle member fixedly mounted to the lower end of said bottle and in fluid communication with the interior chamber, said male nozzle member having a plurality of apertures thereon through which a liquid from the bottle is dispensed, said male nozzle member also including a sealing member;

a female nozzle member rotatably mounted on said male member, said female nozzle member including a cavity for receiving liquid from said male nozzle member and an outlet port through which fluid from said cavity is dispensed;

a cleaning brush mounted to said female nozzle member whereby said brush member is rotated in a first direction so that said sealing member seats within said outlet port to prevent fluid flow therethrough and is rotated in an opposite direction to remove said sealing member from said outlet port to allow fluid flow therethrough.

2. A carpet refurbishing kit according to claim 1 wherein said bottle further comprises an adjustable output spray assembly mounted on the upper end.

3. A carpet refurbishing kit according to claim 2 wherein said spray assembly includes:

a cap member rotatably mounted to the upper end of said bottle, said cap member further including a plurality of spray orifices thereon, each orifice configured to form a select spray pattern when liquid is delivered therethrough;

a dispensing tube fixably mounted within said bottle having an upper end immediately beneath said cap and a lower end extending into said liquid retaining chamber whereby said cap member is rotated until a select spray orifice registers with the upper end of said tube.

4. A carpet refurbishing kit according to claim 1 wherein said bottle is prepackaged within a container, said container having a plurality of variably configured perforated removable portions to form a template to assist a user in applying liquid from said container to a predetermined area.

5. A carpet refurbishing kit according to claim 4 further comprising a plurality of varying colored dyes received within said container.

6. A carpet refurbishing kit comprising:

a substantially hollow bottle having an interior liquid retaining chamber, a lower end and an upper end;

a cleaning brush rotatably mounted to said lower end of said bottle;

a liquid dispensing means mounted to the lower end of said bottle and in fluid communication with the interior chamber of said container for dispensing fluid therefrom, said dispensing means operable by rotating said cleaning brush in a predetermined direction;

an adjustable output spray assembly, said spray assembly including a cap member rotatably mounted to the upper end of said bottle, said cap member including a plurality of spray orifices thereon, each orifice configured to form a select spray pattern when liquid is delivered therethrough, said spray assembly further including a dispensing tube fixably mounted within said bottle having an upper end immediately beneath said cap and a lower end extending into said liquid retaining chamber whereby said cap member is rotated until a select spray orifice registers with the upper end of said tube.

7. A carpet refurbishing kit according to claim 6 wherein said bottle further comprises an adjustable output spray assembly mounted on the upper end.

8. A carpet refurbishing kit according to claim 6 wherein said dispensing means comprises:

a male nozzle member fixedly mounted to the lower end of said bottle and in fluid communication with the interior chamber, said male nozzle member having a plurality of apertures thereon through which a liquid from the bottle is dispensed, said male nozzle member also including a sealing member;

a female nozzle member rotatably mounted on said male member and attached to said brush, said female nozzle member including a cavity for receiving liquid from said male nozzle member and an outlet port through which fluid from said cavity is dispensed whereby said brush is rotated in a first direction so that said sealing member seats within said outlet port to prevent fluid flow therethrough and is rotated in an opposite direction to remove said sealing member from said outlet port to allow fluid flow therethrough.

9. A carpet refurbishing kit according to claim 8 wherein said bottle is prepackaged within a container, said container having a plurality of variably configured perforated removable portions to form a template to assist a user in applying liquid from said container to a predetermined area.

10. A carpet refurbishing kit according to claim 9 further comprising a plurality of varying colored dyes received within said container.

11. A carpet refurbishing kit comprising:

a substantially hollow bottle having an interior liquid retaining chamber, a lower end and an upper end, said bottle prepackaged within a container, said container having a plurality of variably configured perforated removable portions to form a template to assist a user in applying liquid from said container to a predetermined area;

a cleaning brush rotatably mounted to said lower end of said bottle;

a liquid dispensing means mounted to the lower end of said container and in fluid communication with the interior chamber of said container, said dispensing means operable by rotating said cleaning brush in a predetermined direction.

12. A carpet refurbishing kit according to claim 11 wherein said bottle further comprises an upper end having an adjustable output spray assembly mounted thereon.

13. A carpet refurbishing kit according to claim 12 wherein said dispensing means comprises:

a male nozzle member fixedly mounted to the lower end of said bottle and in fluid communication with the interior chamber, said male nozzle member having a plurality of apertures thereon through which a liquid from the bottle is dispensed, said male nozzle member also including a sealing member;

a female nozzle member rotatably mounted on said male member, said female nozzle member including a cavity for receiving liquid from said male nozzle member and an outlet port through which fluid from said cavity is dispensed whereby said female member is rotated in a first direction so that said sealing member seats within said outlet port to prevent fluid flow therethrough and is rotated in an opposite direction to remove said sealing member from said outlet port to allow fluid flow therethrough.

14. A carpet refurbishing kit according to claim 13 wherein said spray assembly includes a cap member rotatably mounted to the upper end of said bottle, said cap member further including a plurality of spray orifices thereon, each orifice configured to form a select spray pattern when liquid is delivered therethrough;

a dispensing tube fixably mounted within said bottle having an upper end immediately beneath said cap and a lower end extending into said liquid retaining chamber whereby said cap member is rotated until a select spray orifice registers with the upper end of said tube.

15. A carpet refurbishing kit according to claim 14 further comprising a plurality of varying colored dyes received within said container.

* * * * *